United States Patent [19]

Denker

[11] 4,057,007

[45] Nov. 8, 1977

[54] ROTARY FLUID DEVICE HAVING TWO ROTOR SECTIONS

[75] Inventor: James M. Denker, Scituate, Mass.

[73] Assignee: Nutron Corporation, Hingham, Mass.

[21] Appl. No.: 669,881

[22] Filed: Mar. 24, 1976

[51] Int. Cl.[2] ..... F01B 3/04; F16H 53/00

[52] U.S. Cl. ..... 91/501; 74/567

[58] Field of Search ..... 91/487, 492, 501; 74/567, 568 R

[56] References Cited

U.S. PATENT DOCUMENTS

| | | | |
|---|---|---|---|
| 3,086,477 | 4/1963 | Ruhl | 91/485 |
| 3,357,362 | 12/1967 | Orr | 91/492 |
| 3,470,825 | 10/1969 | Gsching | 91/494 |
| 3,510,232 | 5/1970 | Reeve et al. | 74/568 |
| 3,880,052 | 4/1975 | Denker | 91/501 |
| 3,969,986 | 7/1976 | Ohrberg | 91/492 |

FOREIGN PATENT DOCUMENTS

| | | | |
|---|---|---|---|
| 838,088 | 6/1960 | United Kingdom | 74/568 |

*Primary Examiner*—John J. Vrablik

[57] ABSTRACT

A rotor comprises two rotor sections mounted coaxially on a shaft for limited axial movement relative to each other. The two sections are slightly spaced axially from each other and one defines a peripheral porting surface engaging a second porting surface defined by a porting member. The rotor has a plurality of bores each carrying a piston and including a first portion defined by one of the rotor sections, a second portion defined by the other of the rotor sections, and an intermediate portion extending between the rotor sections. The pistons engage a cam comprising a sheet pressed into a configuration including a plurality of coaxial annular sheet portions. One sheet portion defines the undulating cam surface; two other sheet portions extend parallel to each other and perpendicular to the one portion from the opposite sides of the one portion.

23 Claims, 8 Drawing Figures

FIG I

ROTARY FLUID DEVICE HAVING TWO ROTOR SECTIONS

Figure 1:
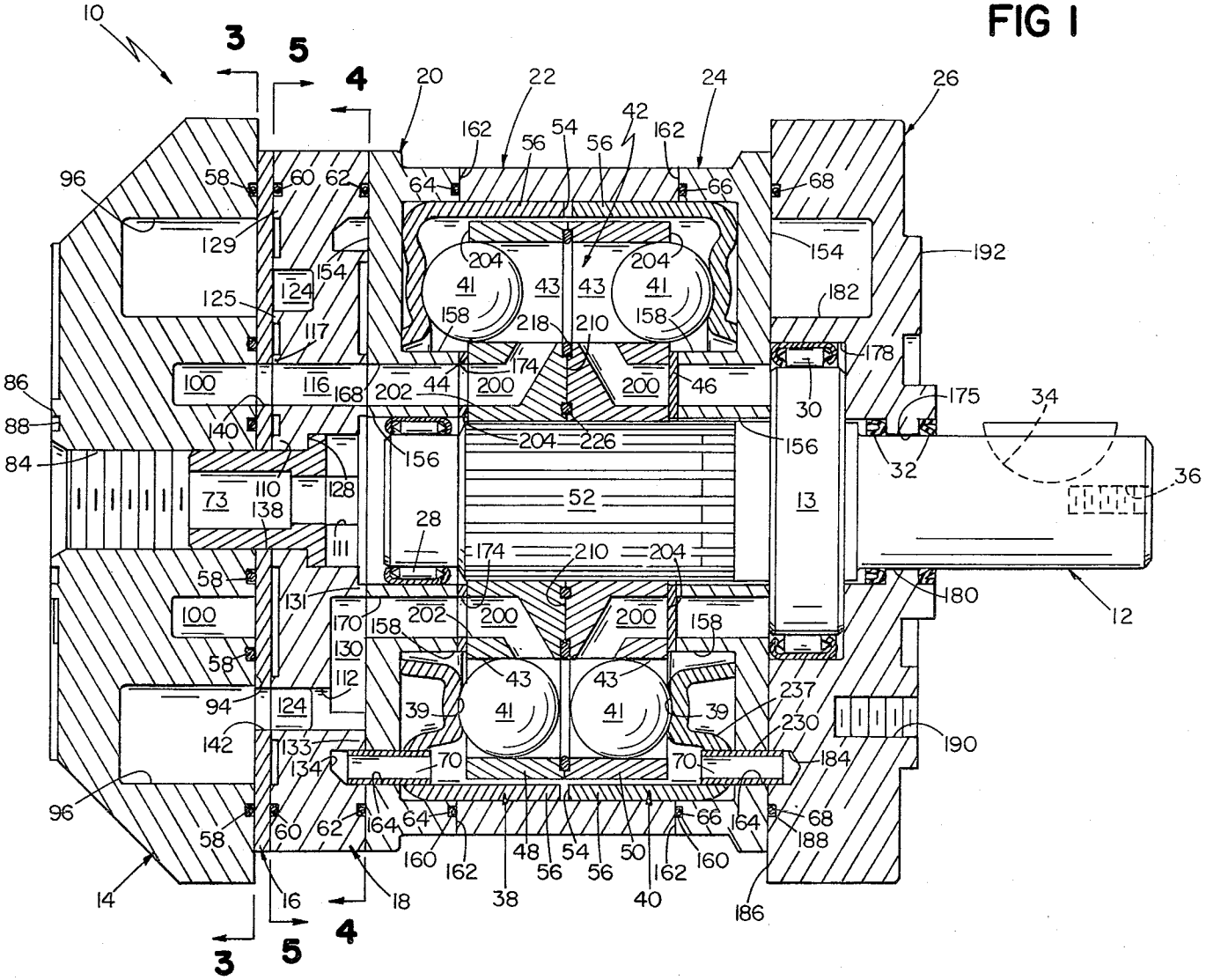

This invention relates to rotary fluid devices.

My prior U.S. Pat. Nos. 3,662,551 and 3,880,052 disclose a high gain fluid pump or motor in which the differential pressure across operating elements is kept to a minimum, moving parts are inherently dynamically balanced, and operating clearances between moving and stationary parts are maintained by hydrostatic balance. It is a principal object of the present invention to provide a fluid pump or motor which has all the advantages of the device of the prior patent, but which includes fewer complex machined parts and is far less expensive to manufacture. Other objects include providing annular wave cams, for use in these and similar devices, which are of pressed sheet steel and provide an extremely rigid, strong, and stable cam track without the need of costly finishing.

The invention is concerned with rotary fluid devices of the type including a shaft, a cam defining an undulating cam surface, a rotor mounted coaxially of the shaft and defining a peripheral porting surface, a plurality of pistons engaging the cam carried by the rotor for movement relative thereto. In one aspect the invention features a rotor comprising two rotor sections mounted coaxially on the shaft for limited axial movement relative to each other, the two sections being slightly spaced axially from each other and one of the sections defining a peripheral porting surface engaging a second porting surface defined by a porting member. The rotor has a plurality of bores each carrying a piston and including a first portion defined by one of the rotor sections, a second portion defined by the other of the rotor sections, and an intermediate portion extending between the rotor sections. In a second aspect, the invention features a cam comprising a sheet pressed into a configuration includng a plurality of coaxial annular sheet portions, a first sheet portion defining the undulating cam surface, and second and third sheet portions extending parallel to each other and perpendicular to the first portion from the opposite sides thereof.

Preferred embodiments of the invention, including both aspects and in which the rotor bores are axially-extending and the pistons are movable therein, further feature rotors comprising two identical rotor sections, O-rings defining the intermediate bore portions set in counterbores surrounding the bore portions of each section and having a total area greater than the affective porting surface area, an annular elastomeric seal having a sealing diameter not greater than the inner diameter of the porting surface engaging and extending between the rotor sections radially intermediate the shaft and the rotor bores, and a cam having inner and outer cylindrical walls extending coaxially of the device in opposite directions from a intermediate portion including a generally axially-facing wall defining the cam surface.

Figure 2:
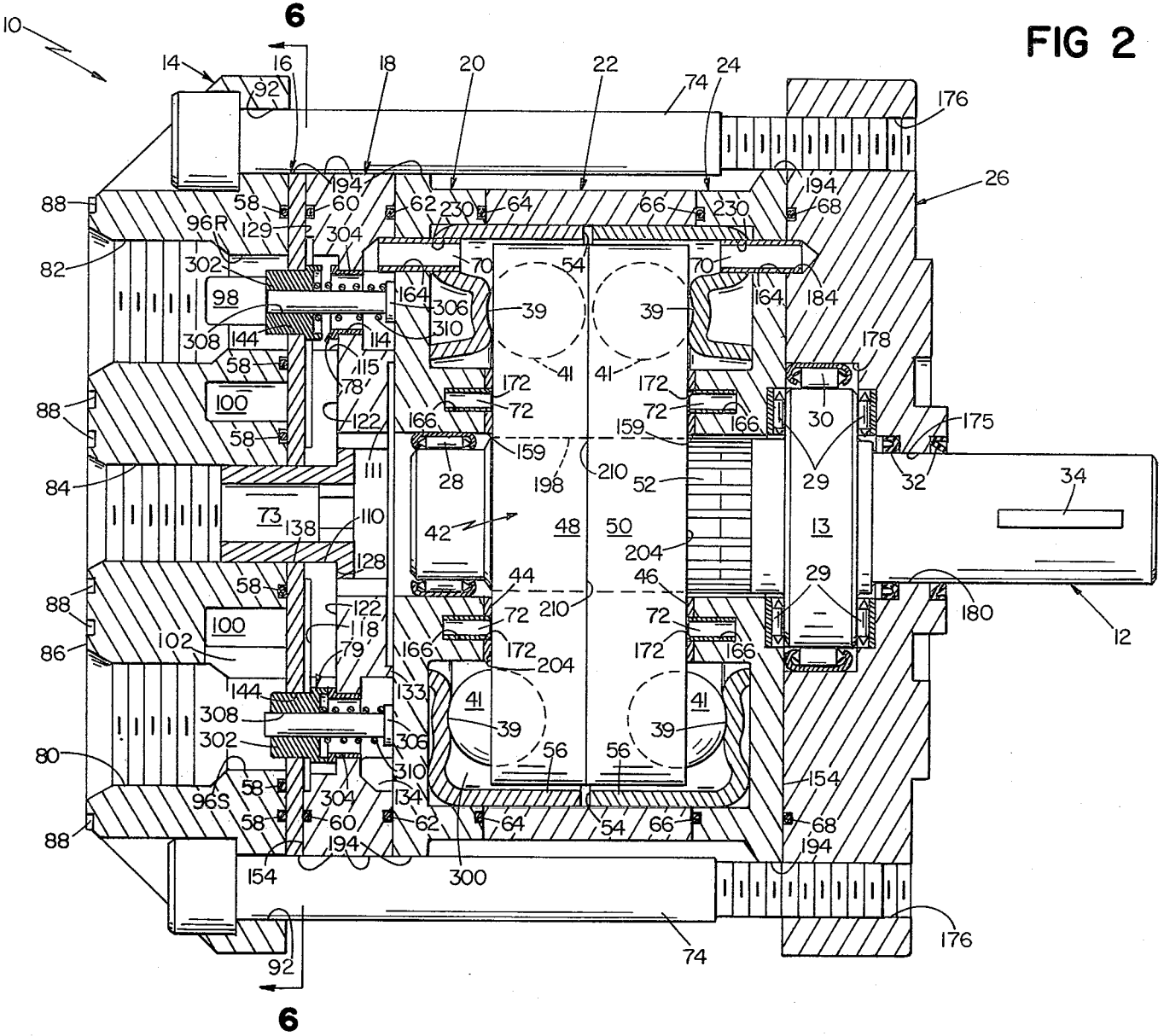
Figure 8:
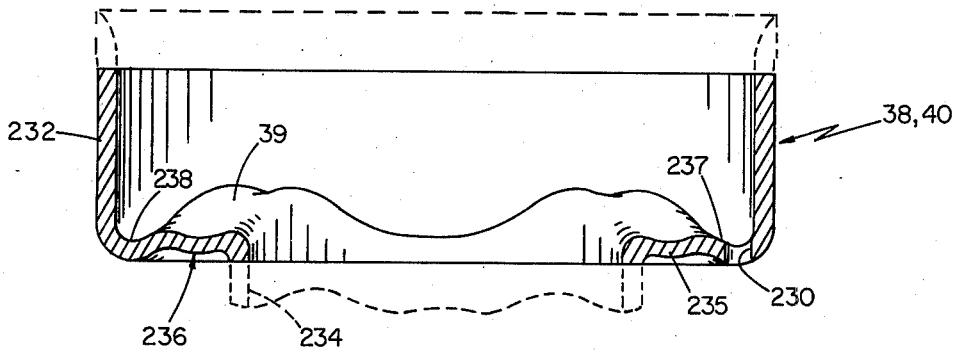
Figure 4:
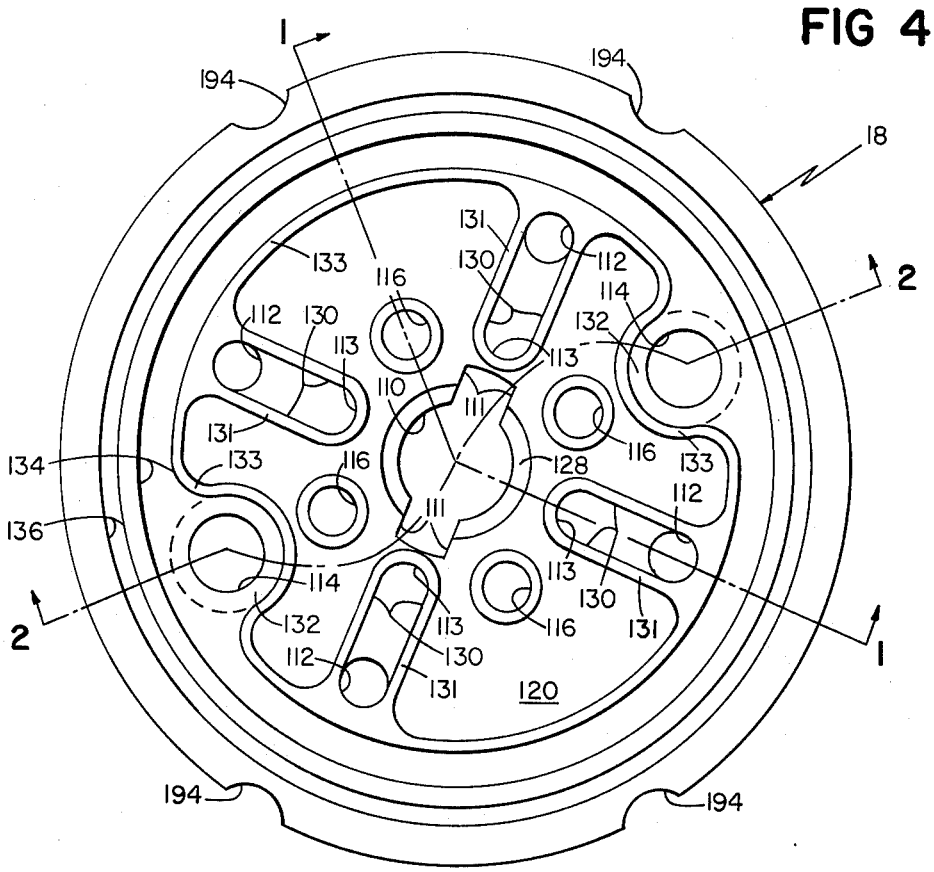
Figure 6:
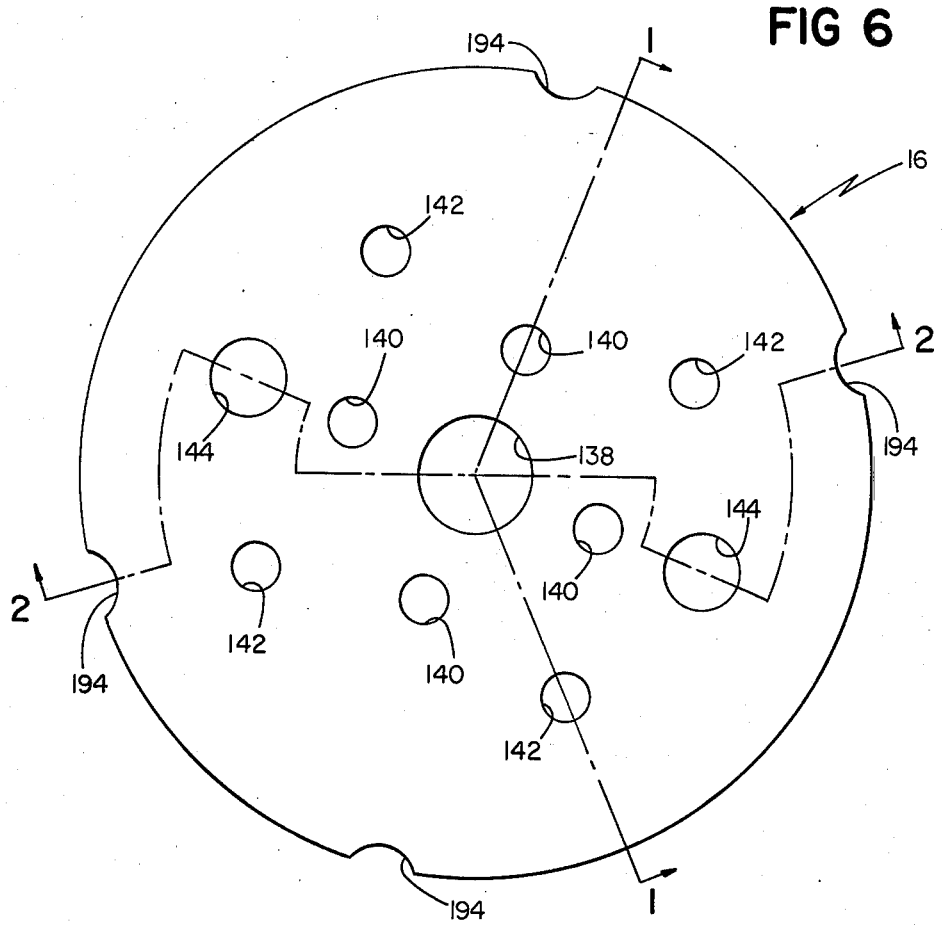
Figure 7:
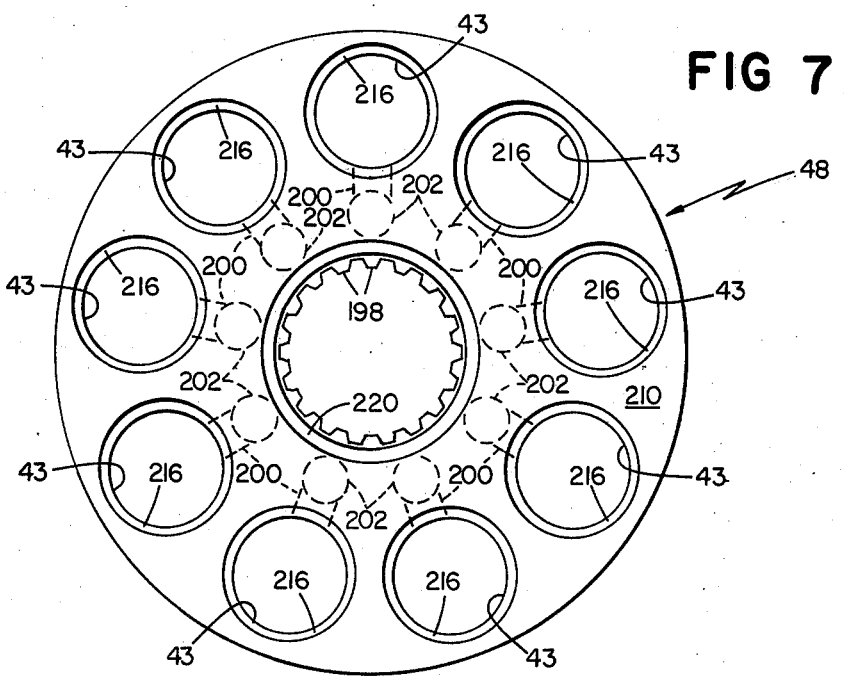

Other objects, features and advantages will appear from the following detailed description of a preferred embodiment of the invention, taken together with the attached drawings in which:

FIGS. 1 and 2 are longitudinal sectional views of a rotary fluid device embodying the present invention;

FIGS. 3, 4, 5, and 6 are sectional views taken at lines 3—3, 4–4, and 5—5 of FIG. 1 and line 6—6 of FIG. 2;

FIG. 7 is a plan view of one of the rotor halves of the device of FIG. 1; and, FIG. 8 is a sectional view of one of the cams of the device of FIG. 1. In FIGS. 1 and 2, some parts of the device are shown rotated from their true positions for purposes of clarity. FIGS. 3–6 show, for different parts of the device, the lines along which the sections of FIGS. 1 and 2 are taken.

Referring more particularly to the drawings, and especially to FIGS. 1 and 2, there is illustrated a rotary fluid motor 10 comprising an output shaft 12 extending coaxially within a multi-part housing including, in coaxial alignment from left to right (as viewed in FIG. 1), an end plate 14, a baffle plate 16, a distributor plate 18, a first port/seal plate 20, a housing 22, a second port/seal plate 24, and a front flange 26. One end of shaft 12 is journalled within a needle bearing 28 mounted in seal plate 20. The other end of shaft 16 extends through front flange 26 and an intermediate annular shoulder 13 is journalled within needle bearing 30 and between pairs of thrust bearings 29. Rubber lip seals 32 surrounding shaft 12 prevent leakage between the shaft and front flange 26. A keyway 34 and pilot hole 36 are provided in the portion of shaft 12 projecting axially from the motor housing.

A pair of identical annular cams 38, 40 and a rotor 42 are mounted within the annular cavity surrounding shaft 12 and defined by housing 22 and port/seal plates 20, 24. Nine cylindrical bores 43 extend coaxially through rotor 42. Two steel ball pistons 41 are mounted within each bore 43 for movement therein in engagement with a respective one of cams 38, 40. A face seal 44, 46, respectively, is mounted at each end of rotor 40. Each of face seals 44, 46 coaxially surrounds shaft 12 and is in face-to-face engagement with the adjacent axial end of the rotor and the adjacent axial face of the adjacent one of port/seal plates 20, 24. Rotor 42 comprises two identical rotor half sections 48, 50 mounted coaxially in close face-to-face engagement and circumferentially fixed relative to shaft 12 by spline 52. Each of cams 38, 40 has the general form of a circular disk having a large axial hole in the bottom thereof. The remaining portion of the bottom has been formed (in a manner discussed in more detail hereinafter) to define an undulating annular cam track 39. The cams are mounted within housing 14, coaxially surrounding shaft 12, with one of cam tracks 39 on each side of rotor 42 and with the adjacent axial ends 54 of the cylindrical side walls 56 of the cams 38, 40 spaced slightly from each other.

The various interfaces between parts of the motor housing (that is the interfaces between end plate 14 and baffle plate 16, between baffle plate 16 and distributor plate 18, between distributor plate 18 and first seal plate 20, between first seal plate 20 and housing 22, between housing 22 and second seal plate 24, and between second seal plate 24 and front flange 26) are sealed within a plurality of O-rings, designated 58, 60, 62, 64, 66 and 68, respectively. Pins 70 locate each of cams 38, 40 port/seal plates 20 and 24, distributor plate 18 and front flange 26. End plate 14, baffle plate 16 and distributor plate 18 are relatively located by the housing of control valves 78, 79. Pins 72 fix face seals 44, 46 relative to, respectively, port/seal plates 20, 24. Baffle plate 16, distributor plate 18 and end plate 20 are held tightly together by a clamping sleeve 73, and the entire motor housing is held together by bolts 74.

Figure 3:
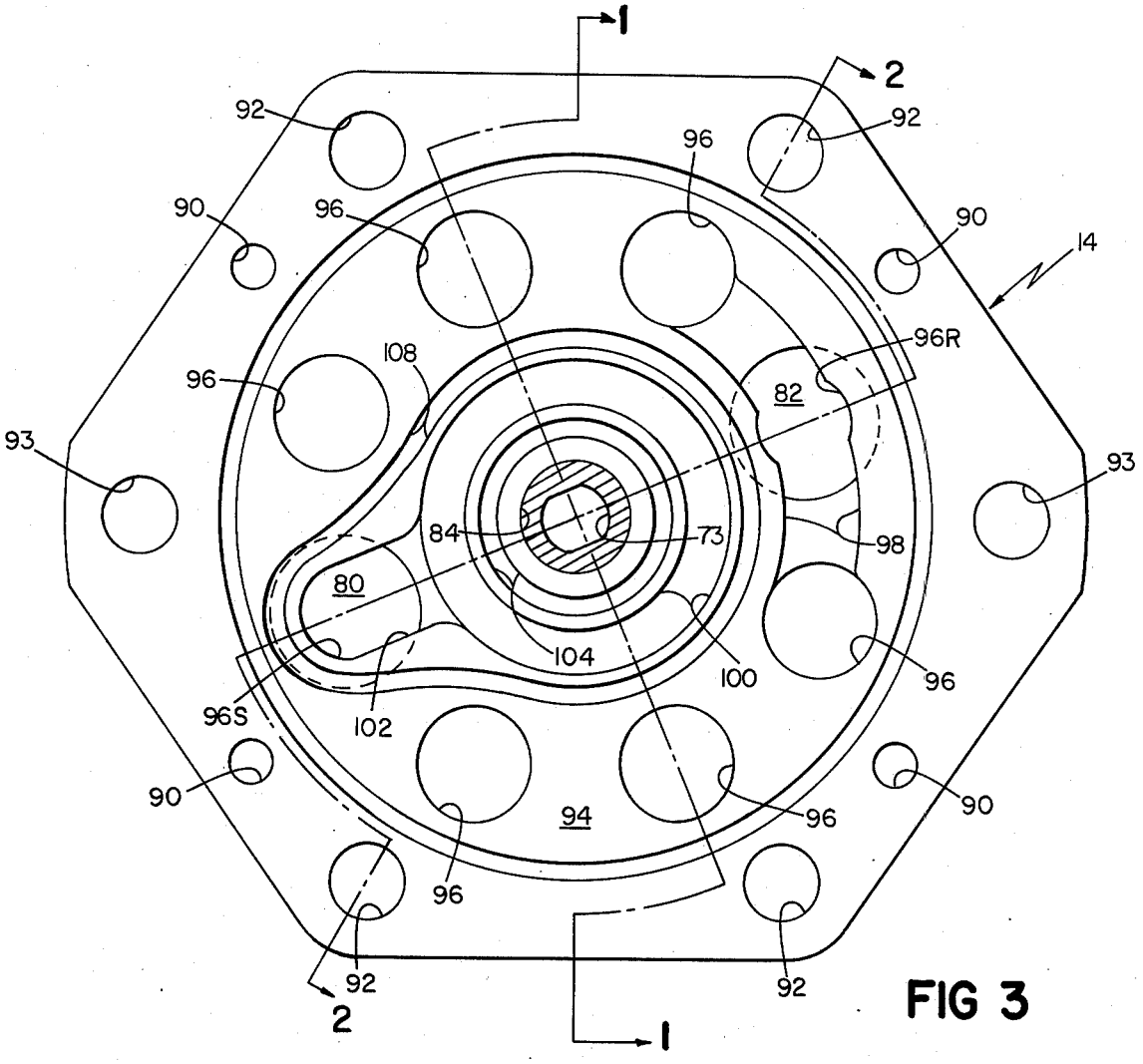

As shown in FIGS. 2 and 3, a supply conduit 80, a return conduit 82, and a drain conduit 84 extend coaxially through end plate 14, spaced from each other with their axes is a common plane. The outer portion of each of conduits 80, 82 is tapped for receiving a fluid coupling. Conduit 84 is tapped through its length to receive a coupling at its outer end and for threaded engagement with clampling sleeve 73 at its inner end. Additionally, so that motor 10 may be connected to a conventional manifold, the axially-facing surface 86 around the conduit outer ends is lapped, recesses 88 for an O-ring surround the outer end of each conduit, and four tapped holes 90 for receiving the bolts supporting the manifold extend coaxially into the end plate spaced around and perpendicular to surface 86. For receiving the bolts 74 holding the parts of motor 10 together, six recessed bolt holes are spaced at 60° intervals around the periphery of the end plate. As shown, two of the holes, designated 93, are diametrically opposed on a circle of 5.750 in. diameter, for direct mounting of the motor on a standard SAE "B" 2 bolt pad. The other four holes, designated 92, are on a circle of 5.00 in. diameter.

Referring more particularly to FIG. 3, eight weight reduction holes 96, spaced from each other at 45° intervals, extend coaxially into end plate 16 from the interior axially-facing surface 94 thereof. One of holes 96, designated 96S, is in coaxial alignment and communication with supply conduit 80; a second, designated 96R is in alignment and communication with return conduit 82.

An arcuate groove 98 in the surface 94 extends approximately 90° between hole 96R and holes 96 on each side thereof. An annular groove 100 in surface 94 surrounds the inner end of drain conduit 84, approximately midway between it and the circle of holes 96, and a connecting groove 102 extends radially from annular groove 100 to hole 96R. An annular recess 104 for receiving one of O-rings 58 surrounds the inner end of drain conduit 84 intermediate it and groove 100. Another of O-rings 58 is mounted in a recess 108 having the general shape of the outer surface of a pear surrounding hole 96S and grooves 100 and 102 and separating them from the rest of holes 96.

Distributor plate 18 (FIGS. 4 and 5) includes a central drain bore 110, four return bores 112, two valving bores 114, and four supply bores 116 extending coaxially therethrough. Central drain bore 110 extends axially through the distributor plate; the other bores are arranged at spaced points around concentric circles of varying diameters. Supply bores 116 are spaced at 90° intervals from each other in the innermost circle (of radius equal to that of groove 100 in end plate 14); return bores 112 at 90° intervals from each other and midway between bores 116 on the outermost circle (of radius equal to that of end plate groove 98). Valving bores are located diametrically opposite each other radially slightly inwardly from return bores 112 (to be coaxial with conduits 80, 82) and in radial alignment with respective ones of supply bores 116.

To provide for fluid flow between selected ones of the bores, sets of connecting grooves are cut into each of the axial faces 118, 120 of distributor plate 18. Three sets of grooves are provided in axial face 118 facing end plate 14 (see FIG. 5). Grooves 122 extend generally radially (in smooth arcs to pass around bores 116) from axial slots 111 on opposite sides of central drain bore 110 to counterbores 115 surrounding valving bores 114. Arcuate grooves, 124 on opposite sides of grooves 122, connect respective pairs of return bores 112, and extend through arcs of about 90°. An annular O-ring groove 127, in which O-ring 60 is mounted, lies between grooves 120 and the outer rim of distributor plate 18. For pressure relief the portion of face 118 within O-ring groove 127 is recessed, except for an annular ring 129 within O-ring groove 127, raised oblongs 125 surrounding grooves 124, and raised rings 117 surrounding bores 116.

In distributor face 120 (facing towards rotor 42, FIG. 4) a counterbore 128 of diameter slightly less than the width of slot 111 and extending axially into the face for about half the thickness of distributor plate 18, coaxially surrounds central drain bore 110. A groove 130 extends radially-inwardly from each of return bores 112 to a counterbore 113 of diameter equal to, midway between a pair of, and lying on the same circle as, each of supply bores 116. Counterbores 132 around each of valving bores 114 are connected by a 360° annular groove 134 whose radially inner edge is substantially tangent to bores 114. An annular O-ring groove 136, in which O-ring 62 is mounted, coaxially surrounds groove 134. The portions of surface 120 within groove 134 (except for raised rims 131 surrounding grooves 130, bores 112 and counterbores 113, and raised ring 133 within groove 134 and counterbores 132) are recessed for pressure relief.

The construction of baffle plate 16, which controls fluid flow between end plate 14 and distributor plate 18, is shown most clearly in FIG. 6. As there shown, baffle plate 16 includes a central bore 138, four supply bores 140, four return bores 142, and two valving bores 144 spaced from each other and extending therethrough with their axes parallel. Supply bores 140 are arranged to communicate with groove 100 of end plate 14 and supply bores 116 of distributor plate 18. Each of return bores 142 is coaxially aligned with one of return bores 112 of distributor plate 18. Two of return bores 142 (one associated with each of grooves 124 of distributor plate 18) communicate with the weight reduction holes 96 in end plate 14 on opposite sides of hole 96R connected by end plate groove 98. Valving bores 144 extend between distributor plate bores 114 and the two end plate weight reduction holes 96 aligned with conduits 80 and 82.

Except as indicated hereinafter, port/seal plates 20 and 22 are identical to each other. Each includes a flat axially-facing outer end surface 154 for engaging, respectively, the adjacent surface of distributor plate 18 or end flange 26, a central bore 156 extending coaxially therethrough, an annular recess 158 in its inner axial surface for receiving a respective one of cams 38, 40, an O-ring groove 160 surrounding recess 158 in which the respective one of O-rings 64, 66 is mounted, an axially-facing annular surface 162 engaging the adjacent end surface of housing member 22, four pin locating and drain holes 164 spaced at 90° intervals from each other and extending therethrough (in such a position that the drain holes 164 in port plate 20 communicate with groove 134 of distributor plate 18), and two diametrically opposed pin locating holes 166 extending into the axially-inner face radially intermediate central bore 156 and recess 158.

As shown in FIGS. 1 and 2, hollow locating pins 70 are mounted in locating and drain holes 164, and hollow pins 72 project into locating holes 166. Housing member 22 comprises a cylindrical tube positioned intermediate and axially engaging port/seal plates 20 and 24 and having an inner diameter equal to the outer diameter of recesses 158.

Port plate 20 and seal plate 24, each include a total of eight drilled conduits extending therethrough arranged in a ring coaxial with an intermediate central bore 156 and recess 158. The conduits of seal plate 24 are blind and may, if desired, be omitted. Four of the conduits in port plate 20, designated 168, are spaced at 90° intervals from each other and communicate with supply bores 116 of distributor plate 18. The other four conduits of port plate 20, designated 170 and spaced at 90° intervals from each other and 45° intervals from adjacent ones of conduits 168, communicate with the grooves 130 intersecting distributor plate return bores 112. Locating holes 166 lie in the same ring as conduits 168, 170 and are positioned midway between an adjacent pair of a conduit 168 and a conduit 170.

Each of face seals 44, 46 comprises a thin annular disc having an inner diameter equal to that of central bore 156 of port/seal plates 20, 24 and an outer edge 159 of diameter equal to the inner diameter of recesses 158. Diametrically opposed pin locating holes 172, in which pins 72 are mounted, extend through the face seals and fix them coaxially in position relative to the port/seal plates. Face seal 44 (but not face seal 46 which blocks the ends of the conduits of seal plate 24), includes eight circumferentially spaced ports 174, each coaxially aligned with and having a diameter equal to that of one of conduits 168, 170.

Front flange 26 includes a stepped cylindrical bore 175 extending coaxially therethrough and four tapped bolt holes 176 extending through peripheral portions thereof. As shown, bore 175 includes an axially inner portion 178 in which needle bearing 30 and thrust bearing 29 are mounted, a reduced diameter portion 180 closely surrounding shaft 12 and, on opposite ends of portion 180, annular grooves in which lip seals 32 are mounted. Eight circumferentially-spaced weight reduction holes 182 and four blind holes 184 for receiving pins 70 project axially into flange 26 from its axially-inner face 186. An annular O-ring groove 188 in which O-ring 68 is mounted surrounds holes 182, 184. Four tapped holes 190 project axially into the front face 192 of face flange 26 for securing the motor to a four-bolt face mounting.

Motor 10 is held together, and end plate 14, baffle plate 16, distributor plate 18, port/seal plates 20, 24 and front flange 26 are rotationally positioned relative to each other, by bolts 74. As previously indicated and shown in FIG. 3, the four bolt holes 92 in end plate 14 are not spaced at equal intervals around the edge of the plate but are rather arranged into two pairs, each pair including two holes 92 spaced 60° from each other and 120° from the most adjacent hole 92 of the other pair. Bolt holes 176 in front flange 26 are similarly positioned. Each of baffle plate 16, distributor plate 18, port plate 20, and seal plate 24 includes four arcuate recesses 194 in its outer periphery, each recess 194 having a radius equal to that of one of bolts 74. As with the bolt holes in end plate 14 and front flange 26, the arcuate recesses 194 in each of those motor parts are arranged in two pairs, each pair including two recesses 194 spaced 60° from each other and 120° from the nearest recess 194 of the other pair.

In baffle plate 16 (FIG. 6), the adjacent recesses 194 of the different pairs are spaced 60° on opposite sides of a line extending diametrically of plate 18 midway between conduits 144 and the most adjacent (in a clockwise direction as viewed in FIG. 6) ones of conduits 142.

Figure 5:
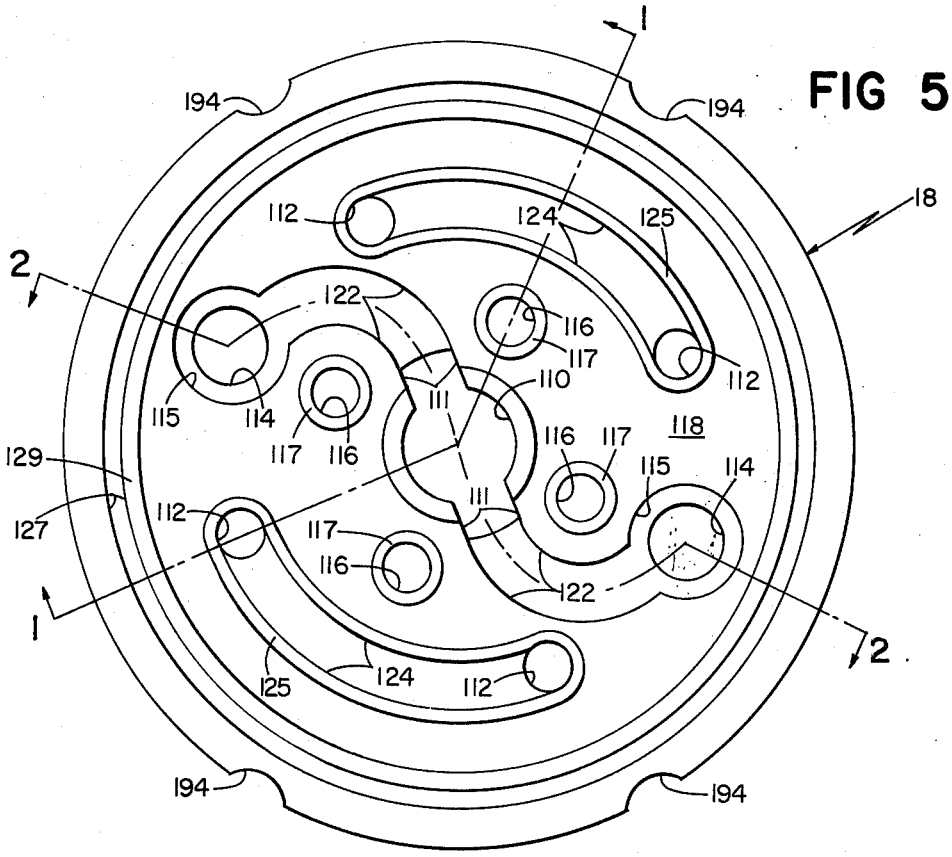

Recesses 194 in distributor plate 18 are positioned (as shown in FIG. 5) with the adjacent recesses of the two different pairs positioned 60° on opposite sides of a line extending diametrically of the plate midway between each of conduits 114 and the most closely adjacent (in a counterclockwise direction as viewed) one of conduits 112.

In port/seal plates 20, 24, the recesses 194 of each pair of equidistantly spaced at 30° on opposite sides of a line extending diametrically through pin locating holes 166.

It should be noted that, in each of baffle plate 16, distributor plate 18, and port/seal plates 20, 24, a line extending diametrically of the plate and bisecting the 60° angles between each pair of recesses 194 of the plate will divide the plate into two identical halves rotated 180° with respect to each other.

Referring now to FIG. 2, the adjacent surfaces of port plae 20, housing 22, seal plate 24 and rotor 42 define an annular chamber300 of substantially U-shaped cross-section surrounding the portion of rotor 42 including bores 43 and balls 41 and in which cams 38, 40 are mounted. Valves 78, 79, mounted in bores 114 of distributor plate 18 and bores 114 of baffle plate 16 control flow from chamber 300 to drain conduit 84. Each of valves 78, 79 includes a valve seat 304 press-fitted within a respective one of bores 114 with an annular radially extending flange at one end thereof lying within counterbore 115, a poppet 302 slip-fitted within a respective one of bores 144, a guide pin 306 slip-fitted within a central bore 308 of poppet 302 with the head of the pin engaging the axially-outer end surface of port plate 20, and a helical bias spring 310 surrounding pin 306 with its opposite ends bearing against adjacent facing axial surfaces of the head of pin 306 and poppet 302. The inner end of poppet 302 includes a radially-outwardly extending flange engaging the inner axial face of baffle plate 18. The other end of poppet 302 lies within one of weight reduction holes 96R, 96S.

As previously indicated, rotor 42 comprises a pair of identical rotor sections 48, 50. As shown in FIGS. 1, 2, and 7 (which illustrates rotor section 48), each rotor section comprises a cylindrical disc having a standard involute spline 52 (18 teeth 198) extending coaxially therethrough with the centers of alternate spline teeth 198 radially aligned with the centers of successive ones of bores 43. A conduit 200 extends from the portion of each of bores 43 defined by the respective rotor section to the axially outer face 204 of the rotor section. As shown, the nine conduits 200 intersect outer axial face 204 in a ring of ports 202 arranged within the ring of bores 43 with each of the ports in radial alignment with one of bores 43. Each conduit extends axially about half the thickness of its respective rotor section then generally radially to the aligned one of bores 43.

The axially-facing inner surface 210 of each rotor section includes a counterbore 216 surrounding the intersecting end of each of bores 43 for receiving an O-ring 218, and an annular recess 220 radially intermediate spline teeth and the ring of ports 202 of conduit portions 200 for receiving an O-ring 226. The maximum depth of each of counterbores 216 and of recess 220 is about 0.0225 in. As will be seen, each O-ring 218 defines the portion of a respective bore 43 through rotor 42 intermediate the bore portions defined by rotor sections 48, 50.

Referring now to FIG. 1, rotor sections 48, 50 are mounted on shaft 12 in coaxial alignement with their respective axially-facing inner surfaces 210 facing and closely adjacent each other. The axially-facing outer surfaces 204 of the two rotor sections are in sliding face-to-face engagement with the adjacent one of face seals 44, 46. The thicknesses of face seals 44, 46 and the axial length of housing 22 are such that the gap between the adjacent rotor section inner surfaces 210 is in the range of 0.001 and 0.003 in. If desired, a shim may be placed between face seal 46 and seal plate 24 to insure the desired thickness.

O-ring 226 and the nine O-rings 218 all have a nominal thickness of 0.070 in. Each of these O-rings is mounted partially within a respective recess or couterbore of rotor section 48 and partially within an adjacent corresponding recess or counterbore of rotor section 50. Since the nominal thickness of each O-ring is substantially greater than the axial distance between the bases of the counterbores or recesses in which it is mounted, each O-ring is compressed.

The cam track 39 defined by each of cams 38, 40 is a trapezoidal acceleration cam surface comprising alternating parabolic and intermediate facing sections. The period of the cam is 90° (that is, each complete annular track includes four substantially identical cycles each having one high point or peak and one low point or valley) and its amplitude (peak-to-valley) is slightly less than one-half the diameter of one of balls 41. Cams 38, 40 are fixed in position relative to port/seal plates 20, 24 by pins 70 extending through pin locating holes 230 with the high points of the cam cycles radically midway between respective pairs of conduits 168, 170. The exact sizes of the balls and cams of motor 10 are such that the displacement of the motor is 10 cubic inches per complete revolution of rotor 42.

As previously indicated, cams 38 and 40 are identical. Each is pressed from a sheet of 11 guage (.1196 nominal thickness) cold rolled steel into a cup-like shape, shown most clearly in FIG. 8, including a large diameter outer cylindrical wall 232 and a smaller diameter inner cylindrical wall 234 extending coaxially in opposite directions from an annular generally radially extending axially-facing center portion 236. The outer diameter of wall 232 is such that it will form a close slip fit with the outer cylindrical surface of recess 158 of port/seal plates 20, 24. The inner diameter of wall 234 is slightly greater than the inner diameter of recess 158. As pressed, the cam includes the waste portions indicated by the dashed lines in FIG. 8. These waste portions are removed during finishing so that the cam has the desired overall axial length and so that the axial-end faces are smooth and perpendicular to the cam's central axis. Central portion 236 includes an inner ring 235 defining a cam track 39, a curved in radial cross-section outer annular ring 238 through which pin locating holes 240 are drilled, and, therebetween, a generally cylindrical support wall 237 (see FIG. 1) generally parallel to inner wall 232 and outer wall 234. As shown, cam track 39, which faces axially and engages balls 41, is not flat in radial transverse cross-section. Rather, track 39 includes an annular central portion having a positive (concave) radius of curvature slightly greater than the radius of balls 41 and a convex annular shoulder on each side of the central portion. At the four high points of the cycles defined by the cam track, both the inner and outer shoulders are tangent to a reference plane.

In operation, fluid is introduced, at high pressure (typically 1,000 p.s.i.), into the motor through conduit 80 and exits from the motor, at low pressure (typically about 500 p.s.i.), through conduit 82. A power stroke of the balls 41 within a bore 43 commences when the balls engage a crest or high point of the ball-engaging cam tracks 39 of cams 38, 40 and, therefore, are in their nearest relative position. With the balls in this position, the rotor port 202 associated with the bore communicates with the end of the conduit 168 that is adjacent to the high point of wave cam. High pressure fluid from inlet conduit passes from the inlet (through end plate groove 100, baffle plate bore 140, distributor plate bores 116, and port/seal plate bores 168) and into the rotor bore 43, thereby forcing the balls 41 within the bore away from each other against the tracks 39 of wave cams 38, 40. The force of the balls against the cam tracks surfaces imparts a torque to and causes rotation of rotor 42. As the rotor rotates, balls 41 roll down the slopes of the cam tracks with which they are in contact, the balls within each bore thereby moving apart. When, after 45° rotation of rotor 42, the balls have reached their most distant relative position, rotor port 202 moves out of communication with port/seal plate conduit 168 and into communication with adjacent return conduit 170 port/seal plate 20. Conduit 170 is connected (through distributor plate grooves 124 and 130 and port 112, baffle plate bore 142 and, for some of conduits 170, end plate 198) to low pressure fluid outlet conduit 82. During the next 45° rotation of rotor 42, balls 41 roll up the slopes of cam tracks 39 thereby moving together and discharging fluid from the bore into the outlet.

Valves 78, 79 maintain the leakage fluid in chamber 300 at a case pressure, $P_3$, that is a predetermined amount below the lesser of the pressures $P_1$, $P_2$, of the fluid in inlet conduit 80 and outlet conduit 82, respectively. A control valve 78, 79 is open when in the configuration of the upper valve in FIG. 2, in which poppet 302 has moved all the way to the left, permitting fluid from chamber 300 to flow (through pin 70, distributor plate groove 134 and counterbore 132, valve seat 304, distributor plate groove 122 and slot 111) to the main drain 84. The force tending to move poppet 302 toward its open position is equal to that exerted by spring 310 plus that exerted by fluid from chamber 300 against the end of poppet 302 surrounding pin 306. Tending to move poppet 302 in the opposite direction is the force exerted by fluid entering the respective one of holes 96R, 96S. The area of the axially-facing end of poppet 302 within the hole 96R, 96S is equal to the effective area of the other end of the poppet. Thus, valve will maintan a differential between pressure $P_3$ and the lesser of pressures $P_1$ and $P_2$ that depends only on the force exerted by spring 310. If, as in the preferred embodiment, the desired differential is 50 p.s.i., the spring exerts a force, F, equal to 50 times the area, in square inches, of the end of poppet 302 surrounding pin 306.

The control valve 78, 79 connected to the greater of pressures $P_1$, $P_2$ will at all times be closed. Thus, if conduit 80 is always connected to high inlet pressure, valve 79 (which is shown in its closed configuration in FIG. 2) may be eliminated. Provision of valves responsive to pressure in both of conduits 78, 79 in ducts leading to each of the channels, however, makes the motor completely reversible. In some embodiments, in which control of case pressure is relatively unimportant, both valves may be eliminated.

As is well-known in the art, the axial gap between the outer axial ends of rotor 40 and seals 44, 46, respectively, must be kept below about 0.0001 in. if the fluid leakage therebetween is to be held within acceptable limits. It will be evident that fluid within annular motor chamber 300, which typically is at a pressure of 400–500 p.s.i., exerts a considerable force on port/seal plates 20, 24 which define the chamber ends. Unless, as generally is not practical, the entire motor is of massive structural strength, this pressure will elastically deform the motor, slightly increasing the axial distance between plates 20, 24. This increase must be compensated for to prevent rotor 42 from being blown away from seal 44, thereby permitting leakage flow directly from port plate 20 into chamber 300 at a volumetric rate that may be equal to or greater than the working fluid flow through the rotor.

One method for compensating for such an increase is shown in my U.S. Pat. Nos. 3,602,551 and 3,880,052, in which an axially movable porting cartridge is pressure balanced so as to always to engage the rotor. This system works perfectly, but the port cartridge and some of the other required parts arc complex and/or expensive to machine.

According to the present invention, the compensation and pressure balance are provided by the rotor itself; and the number of complex, expensive machined parts is drastically reduced.

As will be evident, fluid under pressure from chamber 300 flows radially inwardly into the axial gap between adjacent faces 210 of rotor sections 48, 50. The annular area radially outward of the effective sealing diameter of O-ring 226 (except for the nine circular areas defined by the outer peripheries of the O-rings 218 surrounding bores 43) is under pressure. Because O-ring 226 is elastomeric and thus transmits pressure across its radial thickness, its effective sealing diameter is its inner diameter (the effective sealing diameter of a rigid member, which did not so transmit pressure, would be the outer diameter). Force is exerted on the adjacent axially-facing 210 radially outward of the effective sealing diameter of 0-ring 226, tending to force rotor sections 48, 50 axially apart and into close contact with seals 44, 46. The net rotor-section spreading force is equal to the pressure within chamber 300 ($P_3$) times the area of the annulus radially intermediate the sealing diameter of O-ring 226 and a circle of diameter equal to that of the outer edge 159 of seals 44, 46.

Other forces urging the rotor sections apart work on the annular axially-facing surfaces defined by counterbores 216 surrounding bores 43. Because O-rings 218 are elastomeric and thus transmit pressure, the pressure forces within bores 43 work across the full radial width of the annular axially-facing surface of each counterbore 216. The exact force acting on any one such annulus varies during operation as different ones of bores 43 move into and out of communication with different ones of inlet and outlet conduits 168 and 170. The average (steady state) force is the product of (a) the sum of the areas of the nine annuli and (b) the difference between (i) the average of the inlet and outlet purposes, $P_1$ and $P_2$, and (ii) the case pressure $P_3$ within chamber 300.

At the interface between rotor 42 and seal 46, fluid from chamber 300 at pressure $P_3$ tends to force the rotor axially away from the seal. Since, however, the inner diameter of O-ring 226 between rotor sections 48, 50 is substantially equal to that of seal 46, the net spreading force produced in the nine O-rings annulii surrounding bores 43 will always bias rotor section 50 towards seal 46.

At the interface between rotor 42 and seal 44, the fluid tending to blow the rotor away from the seal is at higher pressure. Half of the ports 174 in seal 44 are at inlet pressure $P_1$, half are at outlet pressure $P_2$, and there are pressure gradients between the ports and across the annuli radially within and without the ports. The total force tending to blow rotor 42 away from seal 44 is approximately equal to the average of the inlet pressure $P_1$ and outlet pressure $P_2$ times the effective area of the axially-facing porting surface defined by seal 44. The effective area is the sum of (a) 100% of the area of the porting annulus (the annular surface whose inner and outer surfaces are tangent to ports 174) and (b) a lesser percentage of the areas of the border annuli (the annular surfaces radially within and without the porting annulus). The lesser percentage depends on the pressure gradients across the border annuli. As used in the claims the "effective area" of a porting surface is 100% of the area of the porting annulus plus 50% of the areas of the border annuli. To provide an extra margin in practice, the effective area is usually assumed to include not less than 60% of the areas of the border annuli.

To insure that the rotor will never be blown away from seal 44, the forces tending to separate rotor sections 48, 50 always must exceed the force tending to blow the rotor away from seal 44. This is assured by insuring that blow-off will not occur in two limiting situations, when chamber 300 is vented and the pressure within it is zero p.s.i.g., and when the motor is freewheeling and the case, inlet, and outlet pressures ($P_1$, $P_2$ and $P_3$) are all the same. To satisfy the first condition, the total axially-facing area of the nine annuli surrounding bores 43 (i.e., the axial areas of counterbores 216) is made greater than the sum of 100% of the area of the porting annulus of seal 44 plus 60% of the areas of the seal border annuli. The second condition is satisfied by positioning rotor section recesses 220 so that area of the annulus (between rotor sections 48, 50) radially intermediate the outer edge 159 of seal 44 and the inner diameter of O-ring 226 is greater than the same effective area of seal 44. If these conditions are met the pressure forces tending to separate rotor sections 48, 50 will be greater than those tending to blow the rotor 42 from seals 44, 46 under all operating conditions; the outer axial faces 204 of the rotor will always be in close sliding face-to-face contact with seals 44, 46; and the axial gap between rotor sections automatically will change as required to compensate for variations in the axial distance between port/seal plates 20, 24. In addition to compensating for variations cased by pressure deformation, it will be evident that the present invention also eliminates any need for maintaining extremely close manufacturing tolerances in the axial thicknesses of the rotor sections and housing.

In other embodiments of the present invention, the rotor bores may be radially rather than axially extending. In such embodiments, pairs of radial bores in two rotor sections may be connected by an axially-expandable O-ring seal. In devices having either radial or axial bores, it may in some circumstances be desirable to have inlet and outlet port plates on opposite sides of the rotor, as in my prior U.S. Pat. No. 3,408,465. Devices in which the axial gap between the rotor sections is more than a few thousandths of an inch may include anti-extrusion rings surrounding the inter-rotor section O-rings 218, 226 to prevent the rings from being extruded through the gap.

Other embodiments will be within the scope of the following claims.

What is claimed is

1. In a rotary fluid device of the type including a shaft, a cam defining an undulating cam surface, a rotor mounted coaxially of the shaft and defining a porting surface, a plurality of pistons engaging the cam carried by the rotor for movement relative thereto, a porting member defining an annular porting surface engaging the rotor porting surface, and a plurality of bores defined by said rotor and each carrying at least one of said pistons, that improvement wherein:

said rotor comprises two rotor sections mounted coaxially on the shaft for limited axial movement relative to each other and spaced slightly axially from each other, each of said rotor sections defining a generally axially-facing surface closely adjacent and facing towards the corresponding surface of the other of said rotor sections;

each of said bores includes a first bore portion defined by one of said rotor sections, a second bore portion defined by the other of said rotor sections, and an intermediate portion extending between said rotor sections;

an annular sealing member extends between said axially-facing surfaces of said rotor sections generally coaxially therewith and seals said axially-facing surfaces to each other, the effective sealing diameter of said sealing member being not greater than the inner diameter of said annular porting surface defined by said porting member.

2. The device of claim 1 wherein said sealing member is an O-ring, each of said intermediate members comprises an O-ring fitted partially within a recess associated with a respective one of said bores, and said rotor sections are identical.

3. The device of claim 1 including an annular recess in said axially-facing surface of each of said rotor sections, and wherein said sealing member is an elastomeric member fitted partially within each of said recesses and extending between said recesses, the relaxed length of said elastomeric member being greater than the distance between said rotor sections plus the axial depths of the said recesses in which it is partially fitted.

4. The device of claim 1 wherein said bores extend generally axially through said rotor, said first and second bore portions are of substantially the same diameter, each of said first and second bore portions defines a respective port at a said axially-facing surfaces of one of said rotor sections, and a counter bore in a said axially-facing surface of diameter greater than the diameter of said first and second bore portions surrounds each of said ports thereof at said generally axially-facing surfaces.

5. The device of claim 4 wherein an elastomeric circular in cross-section member is fitted partially within the said counterbores associated with each of said bores and comprises said intermediate portion of said each of said bores.

6. The device of claim 4 wherein each of said rotor sections includes an annular recess in said inner facing surface thereof radially intermediate said shaft and said bores, and said sealing member comprises an elastomeric sealing member extending between said rotor sections and fitting partially within said annular recesses thereof.

7. The device of claim 6 wherein said porting member porting surface is annular, the inner diameters of said annular recesses are not greater than the inner diameter of said porting member porting surface, each of said counterbores defines an axially-facing annular surface, and the sum of the areas of said annular surfaces of said counterbores of each of said rotor sections is not less than the effective area of said porting member porting surface.

8. In a rotary fluid device of the type including a shaft, a cam defining an undulating cam surface, a rotor mounted coaxially of the shaft and defining a porting surface, a plurality of pistons engaging the cam carried by the rotor for movement relative thereto, a porting member defining a porting surface engaging the rotor porting surface, and a plurality of bores defined by said rotor and each carrying at least one of said pistons, that improvement wherein:

said rotor comprises two rotor sections mounted coaxially on the shaft for limited axial movement relative to each other and spaced slightly axially from each other, each of said rotor sections defining a generally axially facing surface closely adjacent and facing towards the corresponding surface of the other of said rotor sections;

each of said bores includes a first bore portion defined by one of said rotor sections, a second bore portion defined by the other of said rotor sections, and an intermediate portion defined by an intermediate member extending between said rotor sections, each of said first and second bore portions defining a respective port at a said axially-facing surface of one of said rotor sections;

each of said rotor sections includes a plurality of recesses in the axially-facing surface thereof facing towards the corresponding surface of the other of said rotor sections, each of said recesses surrounding a said port in said surface defined by a respective one of said bore portions;

each said intermediate member has one end portion thereof fitted within a said recess in said surfaces of one of said rotor sections and an opposite end portion thereof fitted within a said recess in said surface of the other of said rotor sections; and, each of said recesses includes a generally axially-facing surface, the sum of the areas of said recesses of each of said rotor sections projected on a plane perpendicular to the axis of said shaft being greater than the effective area of said porting surface of said porting member projected on said plane.

9. The device of claim 8 wherein each of said intermediate portions comprises an elastomeric member having a relaxed length greater than the axial distance between said rotor sections.

10. The device of claim 8 wherein each said intermediate portion comprises an elastomeric O-ring having a nominal thickness of greater than the axial distance between said rotor sections plus the axial depths of the two said recesses in which said end portions thereof are fitted.

11. The device of claim 8 wherein said recesses are radially outside said porting member porting surface.

12. The device of claim 8 wherein each of said recesses in said axially-facing surfaces is circular in cross-section and said axially-facing surfaces thereof are annular.

13. In a rotary device of the type including a shaft, a cam defining an undulating cam surface, a rotor mounted coaxially of the shaft and defining an annular porting surface, a plurality of pistons engaging the cam carried by the rotor for movement relative thereto, a porting member defining an annular porting surface, and a plurality of axial bores defined by said rotor and each carrying at least one of said pistons, that improvement wherein:

said rotor comprises two substantially identical rotor sections mounted coaxially on the shaft for limited axial movement relative to each other, each of said rotor sections defining a generally axially-facing surface closely adjacent and facing towards the corresponding surface of the other of said section;

each of said bores includes a bore portion defined by each of said rotor sections and coaxial therewith an intermediate portion extending between said rotor sections;

each of said rotor sections defines a said annular porting surface of said rotor and a plurality of conduits each extending from a respective port at said annular porting surface thereof to one of said bore portions thereof;

said porting member is mounted coaxially of said shaft on one side of said rotor and includes a plurality of ports at said annular porting surface thereof arranged to communicate with said ports of one of said rotor sections;

a further member substantially identical to said porting member is mounted coaxially of said shaft on the side of said rotor opposite said porting member; and, each of said rotor sections and said porting member and said further member is symmetrical about a respective transverse plane including the axis thereof.

14. The device of claim 13 including an annular port plate having a plurality of conduits extending axially therethrough mounted coaxially of said shaft intermediate said porting member and said rotor, each of said porting member ports being aligned and communicating with a respective said conduit of said port plate, and a second annular plate mounted coaxially of said shaft intermediate said rotor and said further member.

15. The device of claim 14 wherein said second annular plate is a seal plate covering said ports of said further member.

16. The device of claim 15 including an annular sealing member mounted coaxially of said shaft intermediate said rotor sections and sealing said axially-facing surface of rotor sections to each other radially intermediate said shaft and said intermediate portions, each of said adjacent axially-facing surfaces of each of said rotor sections being free of fluid ports radially intermediate said shaft and said annular sealing member.

17. In a rotor fluid device of the type including a shaft, a cam defining an undulating cam surface, a rotor mounted coaxially of the shaft, and a plurality of pistons engaging the cam carried by the rotor for movement relative thereto, that improvement wherein said cam comprises a sheet pressed into a configuration including a plurality of coaxial annular sheet portions, a first one of said sheet portions defining said undulating cam surface, and second and third ones of said sheet portions extending generally parallel to each other and perpendicular to said cam surface from opposite sides of said first sheet portion.

18. The device of claim 17 wherein said second and third portions extend generally parallel to the axis of said shaft.

19. The device of claim 18 wherein said first sheet portions includes an inner ring defining said cam track and generally perpendicular to and joined to second portion, an outer ring generally perpendicular to and joined to said third portion spaced axially relative to said inner ring, and an intermediate supporting wall joined to said inner and outer rings and extending therebetween generally parallel to said second and third portions.

20. The device of claim 19 including an identical pair of cams.

21. A cam for use with a rotary device of the type including a shaft, a rotor mounted coaxially of the shaft, and a plurality of pistons carried by the rotor for movement relative thereto, said cam defining an undulating cam surface and comprising a sheet pressed into a configuration including a plurality of coaxial annular sheet portions, a first one of said sheet portion defining said undulating cam surface, and second and third ones of said sheet portions extending parallel to each other and generally perpendicular to said cam surface from opposite sides of said first sheet portion.

22. The cam of claim 21 wherein said second and third portions define inner and outer coaxial generally cylindrical walls extending in opposite directions from said first portion.

23. The cam of claim 22 wherein said first sheet portion includes an inner annular ring defining said undulating cam surface and adjoining and generally perpendicular to said second portion, an outer annular ring spaced axially of said cam from said inner annular ring and adjoining and generally perpendicular to said third portion, and an intermediate generally cylindrical supporting wall joined to said inner and outer rings and extending therebetween generally coaxially with said inner and outer walls.

* * * * *

UNITED STATES PATENT AND TRADEMARK OFFICE

CERTIFICATE OF CORRECTION

PATENT NO. : 4,057,007

DATED : November 8, 1977

INVENTOR(S) : James M. Denker

It is certified that error appears in the above-identified patent and that said Letters Patent are hereby corrected as shown below:

Column 5, line 29, "bearing 29" should be --bearings 29--.

Column 6, line 19, "bores 114" should be --bores 144--.

Column 6, line 63, "alignement" should be --alignment--.

Column 9, lines 31-32, "axially-facing 210" should be --axially-facing faces 210--.

Column 9, line 44, "forces within" should be --forces from within--.

Column 10, line 44, "cased" should be --caused--.

Column 11, claim 4, line 42, "surfaces" should be --surface--.

UNITED STATES PATENT AND TRADEMARK OFFICE

CERTIFICATE OF CORRECTION

PATENT NO. : 4,057,007

DATED : November 8, 1977

INVENTOR(S) : James M. Denker

It is certified that error appears in the above-identified patent and that said Letters Patent are hereby corrected as shown below:

Column 12, claim 8, line 32, "surfaces" should be --surface--.

Column 14, claim 19, line 13, "portions" should be --portion--.

Column 14, claim 19, line 14, "to second portion" should be --to said second portion--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*